United States Patent [19]

Bryant et al.

[11] Patent Number: 4,846,024

[45] Date of Patent: Jul. 11, 1989

[54] THREE-WAY OPENER

[75] Inventors: David R. Bryant, Perrysburg; Werner W. Kochte, Streetsboro, both of Ohio; Edward F. Trombly, Huntington Woods, Mich.

[73] Assignee: The Scott Fetzer Company, Westlake, Ohio

[21] Appl. No.: 256,649

[22] Filed: Oct. 12, 1988

[51] Int. Cl.[4] ..... B67B 7/44

[52] U.S. Cl. ..... 81/3.09; 81/3.4; 81/3.55

[58] Field of Search ..... 81/3.07, 3.09, 3.4, 81/3.55; 7/151

[56] References Cited

U.S. PATENT DOCUMENTS

| | | | |
|---|---|---|---|
| D. 238,411 | 1/1976 | Levenson | D8/18 |
| D. 277,635 | 2/1985 | Sherwood | D8/18 |
| 4,414,865 | 11/1983 | Brooks et al. . | |
| 4,455,894 | 6/1984 | Roberts . | |
| 4,474,087 | 10/1984 | Widman . | |
| 4,507,988 | 4/1985 | LoFaso et al. | 81/3.09 |
| 4,560,344 | 12/1985 | Kietaibl | 7/151 |

FOREIGN PATENT DOCUMENTS

| | | | |
|---|---|---|---|
| 1170068 | 7/1984 | Canada | 81/3.55 |
| 1023670 | 6/1985 | United Kingdom . | |

*Primary Examiner*—Roscoe V. Parker

*Attorney, Agent, or Firm*—Pearne, Gordon, McCoy & Granger

[57] ABSTRACT

An opener for tab-top, screw-top and crimped top beverage containers is disclosed. The opener comprises: an injection-molded, substantially flat, elongated handle of an essentially constant wall thickness having a central portion and two ends; a cavity molded in one end of the handle; a serrate frustoconical receptacle molded in the central portion of the handle; an opening molded in the other end of the handle; a passage also molded in the other end and communicating with the opening; and a steel insert frictionally retained in the passage, a portion of the insert protruding into the opening. In use, the cavity receives a tab-top tab, the receptacle engages a screw-top cap, or the opening receives a crimped-top cap, the insert engaging the edge of the cap. The ergonomic handle is then used as a lever to open the container. A permanent magnet may be attached to the opener to allow easy storage on a magnetic surface. The opener may be provided with holes for attaching a cord or tether.

11 Claims, 1 Drawing Sheet

THREE-WAY OPENER

BACKGROUND OF THE INVENTION

The invention relates to combination openers for tab-top, screw-top and crimped-top beverage containers.

Many different openers for beverage container closures have been proposed. Most of these open only one, or possibly two, types of closures. This necessitates having to possess more than one kind of opener. Openers for tab-top, screw top and crimped top beverage containers have been proposed that are stamped out of sheet metal. Metal is relatively expensive and the necessary machines and dies to make the openers are expensive as well. Also, the inherently sharp edges and thin sheets of metal make these openers uncomfortable to use, particularly if many containers are to be opened.

SUMMARY OF THE INVENTION

The opener herein disclosed comprises a substantially flat, elongated, injection-molded plastic handle with a cavity in one end to engage the tab on a tab-top can and a centrally located receptacle to engage a screw-top bottle cap. Towards the other end, it has an opening containing a hard insert, for example, made of steel, to engage the edge or lip of a crimped-top bottle cap.

By allowing the use of injection molding in the manufacture of the opener, substantial cost savings may be realized. Injection-molding machinery is typically much less expensive than metal stamping machinery for complex shapes.

The handle is made of a high-strength, yet relatively inexpensive plastic such as Nylon. This is sufficient for opening tab-top and screw-top containers, but a hard insert is desirable to engage the sharp edge of a crimped-top cap. Without an insert, most plastics would soon be gouged and cut by crimped-top caps until the edge-engaging surface was destroyed. By using a plastic handle with a steel insert, the advantages of light weight and low expense for plastic are combined with the necessary durability of steel for the crimped-top opener.

The speed at which an injection molder may be run depends on how fast the molded article cools. The handle of the present invention has the advantage of being largely of constant wall thickness. This makes for uniform cooling and hence a maximum production rate.

Besides being inexpensive to produce, the present invention has numerous ergonomic advantages. In particular, the location of the screw-top cap receptacle in the central portion of the handle allows the user to apply a force couple to the cap. This makes holding onto the container and opener easier than just applying an unbalanced moment. In addition, the use of plastic allows the opener to be thicker, allowing for smoother edges that more comfortably fit the user's hand. Also, the location of the tab-top cavity at one end, the crimped-top opening at the other end and the screw-top receptacle near the center allows for easy orientation of the opener by feel in dimly lit locations, such as bars.

DESCRIPTION OF THE PREFERRED EMBODIMENTS

Figure 1:
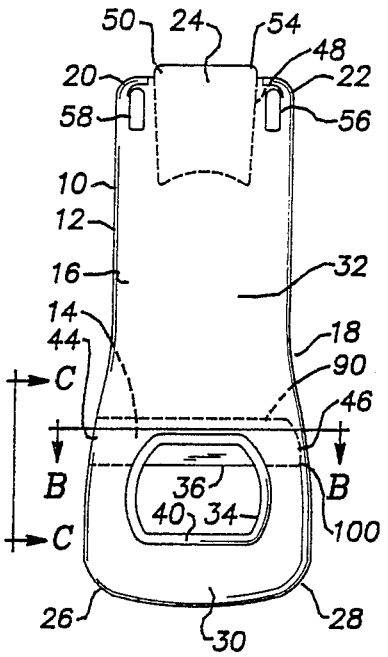
FIG. 1 is a plan view of the top of the opener.

As shown in FIG. 1, opener 10 comprises two parts, handle 12 and insert 14. Handle 12 may be composed of a strong injection molded plastic such as Nylon and insert 14 of steel.

The top 16 of handle 12 is substantially flat. The perimeter 18 of handle 12 has rounded corners 20 and 22 on tab-top end 24 and rounded corners 26 and 28 on crimped-top end 30. Tab-top end 24 is preferably narrower than crimped-top end 30. This allows for easy gripping of tab-top end 24 as a handle in applying the force required to open a crimped-top bottle as well as providing tactile identification of the two ends 14 and 30. The width of handle 12 smoothly increases in the central portion 32 of handle 12 from that of tab-top end 24 to that of the wider crimped-top end 30. This provides additional ergonomic comfort for the user's hand.

Opening 34 extends through handle 12. Insert 14 is disposed within handle 12 such that the edge-engaging portion 36 of insert 14 protrudes into opening 34. Insert 14 is located symmetrically between top 16 and bottom 38 (FIGS. 2 and 3) of handle 12. Opening 34 is sized to accommodate the partial insertion of a crimped-top cap sufficiently to engage portion 36. In operation, portion 36 is engaged under the crimped-top bottle cap edge and levered off, using opening 34 as a fulcrum and handle 14 as a lever. A crimped-top cap may be levered off from either side of handle 14, the cap bearing against either top edge 40 or bottom edge 42 (FIG. 2) of opening 34. Top edge 40 and bottom edge 42 are beveled to provide both a comfortable surface with a minimum of sharp edges and a more durable edge to bear against the cap when prying a crimped-top cap off.

Insert 14 is a substantially flat plate with a square-edged portion 36. Ends 44 and 46 of insert 14 may be advantageously tapered to correspond with the width of handle 12.

Figure 3:
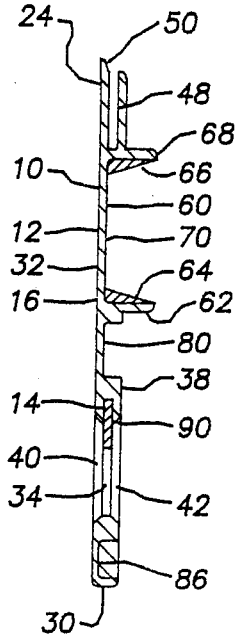
FIG. 3 is a cross-sectional view of the opener through line A-A.

As shown in FIGS. 1 and 3, cavity 48 is formed into tab-top end 24 of handle 12. Cavity 48 is sized to conveniently accommodate a protruding tab-top beverage can tab in a manner substantially parallel to top 16 of handle 12. In operation, cavity 48 is slid over the tab and handle 12 used to lever the tab away from the can, thereby opening the can. Ramp 50 may be provided at the mouth 52 of cavity 48. The edge 54 of ramp 50 may then be used to facilitate moving opener 10 under the tab and ramp 50 used to cam the tab into cavity 48.

Holes 56 and 58 may be provided for convenient attachment of a tether or neck cord.

Figure 2:
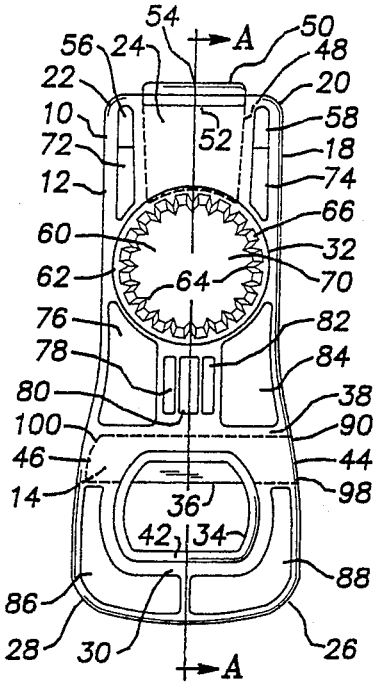
FIG. 2 is a plan view of the bottom of the opener.

Referring to FIGS. 2 and 3, screw-top cap receptacle 60 is located on the central portion 32 of bottom 38 of handle 12. Receptacle 60 is in the form of a cylindrical wall 62 lined with serrations 64. Serrations 64 form a serrated frustoconical inner wall 66. Inner wall 66 decreases in diameter from its entrance 68 to the bottom 70 of receptacle 60. The dimensions of inner wall 66 are adapted to securely engage a twist-off bottle cap. In operation, the twist-off cap is pressed securely into receptacle 60, and a couple applied between ends 24 and 30 of handle 12 coaxial with receptacle 60, thereby unscrewing the bottle cap. Application of a couple instead of just a moment aids the user in keeping the cap pressed into receptacle 60 while applying the twisting force.

To minimize material while retaining necessary strength, as well as to give handle 12 a basically uniform wall thickness throughout, depressions 72, 74, 76, 78, 80, 82, 84, 86 and 88 are formed in bottom 38 of handle 12. For similar reasons, cavity 48 extends to near wall 66. Use of a nearly constant wall thickness allows for uniform cooling of injection-molded parts, thereby allowing maximum throughput.

Perimeter 18 of handle 12 is convexly curved from top 16 to bottom 38 of handle 12. This smooth transition aids in comfortable use of opener 10, particularly when opener 10 is used repetitively.

A rectangular passage 90 is molded in handle 12 to receive insert 14 and has dimensions substantially equal to those of insert 14. Passage 90 commences at perimeter 18 of handle 12 and communicates with opening 34. Passage 90 may continue through to the opposite side of the perimeter of the handle.

Figure 6:
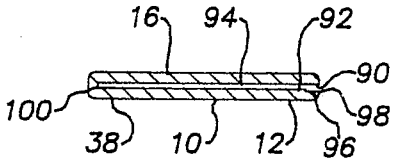
FIG. 6 is a cross-sectional view of the handle through line B—B showing an optional crush rib for retaining a metal insert in the passage of the opener.
Figure 7:
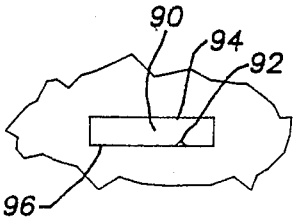
FIG. 7 is a partial, enlarged side elevation view of the opener showing the optional crush rib viewed from line C—C.

Referring to FIGS. 6 and 7, insert 14 is preferably retained within passage 90 by molding a small crush rib 92 into the passage to hold insert 14 in place by friction after insert 14 is forcibly inserted into passage 90. Rib 92 is preferably formed in either the top wall 94 or bottom wall 96 of passage 90 and extends substantially the length of passage 90 (FIG. 6). Rib 92 gradually increases in thickness from wall 94 or 96, being its thinnest near the perimeter opening 98 and its thickest at the end 100 of passage 90. Insert 14 may also be retained in passage 90 by such means as adhesive or welding of the plastic or, alternatively, integrally molded within handle 12.

Figure 4:
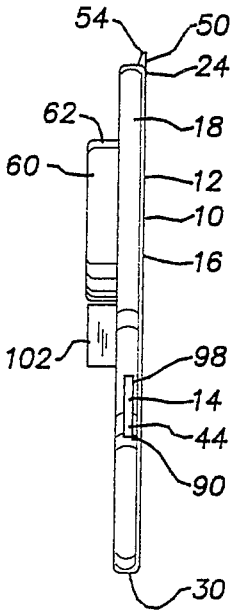
FIG. 4 is a side elevation of the opener showing the optional magnet.
Figure 5:
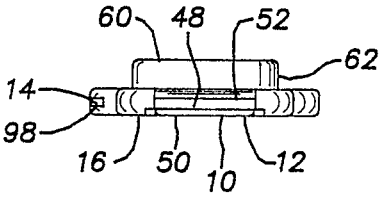
FIG. 5 is an end elevation of the opener showing the tab-top tab cavity.

Referring to FIG. 4, a magnet 102 may be optionally attached to bottom 38 of handle 12 covering depressions 78, 80 and 82. Opener 10 may then be conveniently stored on any metal surface.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An opener for a tab-top, a screw-top and a crimped-top beverage container, comprising:

(a) a substantially flat, elongated handle of an essentially constant wall thickness, said handle having a top, a bottom, a perimeter, a central portion, a first end and a second end;

(b) a cavity, said cavity being molded in the first end of the handle, said cavity having an inlet and being adapted to receive a tab-top tab;

(c) a serrated frustoconical receptacle, said receptacle being molded in the central portion of the handle and being adapted to turnably engage a screw-top cap;

(d) an opening, said opening being molded in the second end of the handle and extending through said handle between the top and bottom;

(e) a passage, said passage also being molded in the second end of the handle and said passage communicating with the opening; and (f) a hard insert, said insert being retained in the passage with a portion of the insert protruding into the opening, said opening being adapted to receive a crimped-top cap having an edge and said insert being adapted to engage said edge, wherein said handle may be leveringly moved to open said tab-top and crimped-top beverage containers and couplingly moved to open said screw-top container.

2. An opener as in claim 1, wherein said handle is injection-molded.

3. An opener as in claim 1, wherein said insert is made of steel.

4. An opener as in claim 1, further comprising a permanent magnet attached to said handle, whereby said opener may be held on a magnetic surface.

5. An opener as in claim 1, further comprising a hole in said handle, whereby said opener may be attached to a tether.

6. An opener as in claim 1, wherein said passage commences in the perimeter of the handle.

7. An opener as in claim 6, wherein said passage further comprises a top wall, a bottom wall, and a crush rib, said rib being formed in and extending outwardly from at least one of said top and bottom walls, wherein the insert may be inserted into said passage from said perimeter and frictionally retained in said passage by crushing said rib.

8. An opener as in claim 1, further comprising a ramp, said ramp being molded in said first end and being disposed at the inlet of the cavity, whereby the tab may be cammed into the cavity.

9. An opener as in claim 1, wherein said opening and insert are symmetrically arranged with respect to the top and bottom, whereby the crimped-top cap may be received in the opening from both the top and the bottom of the handle.

10. An opener as in claim 1, wherein said top is essentially a smooth surface and the second end is wider than the first end, whereby the top, bottom, first end and second end may be easily identified by touch.

11. An opener as in claim 1, wherein the perimeter of the handle is convexly curved between the top and the bottom, whereby the opener fits ergonomically in a user's hand.

* * * * *